US012181149B2

(12) United States Patent
Waldner

(10) Patent No.: US 12,181,149 B2
(45) Date of Patent: Dec. 31, 2024

(54) GRATE BLOCK FOR A COMBUSTION GRATE

(71) Applicant: KANADEVIA INOVA AG, Zürich (CH)

(72) Inventor: Maurice Henri Waldner, Wettingen (CH)

(73) Assignee: KANADEVIA INOVA AG, Zürich (CH)

( * ) Notice: Subject to any disclaimer, the term of this patent is extended or adjusted under 35 U.S.C. 154(b) by 526 days.

(21) Appl. No.: 17/624,977

(22) PCT Filed: Jul. 1, 2020

(86) PCT No.: PCT/EP2020/068504
§ 371 (c)(1),
(2) Date: Jan. 5, 2022

(87) PCT Pub. No.: WO2021/004852
PCT Pub. Date: Jan. 14, 2021

(65) Prior Publication Data

US 2022/0282864 A1 Sep. 8, 2022

(30) Foreign Application Priority Data

Jul. 5, 2019 (EP) ..... 19184560

(51) Int. Cl.
*F23G 5/00* (2006.01)
*F23H 1/02* (2006.01)
(Continued)

(52) U.S. Cl.
CPC ..... *F23G 5/002* (2013.01); *F23H 1/02* (2013.01); *F23H 7/08* (2013.01); *F23H 17/12* (2013.01); *F23H 2700/009* (2013.01)

(58) Field of Classification Search
CPC ..... F23H 17/12; F23H 3/02
See application file for complete search history.

(56) References Cited

U.S. PATENT DOCUMENTS 1,409,205 A * 3/1922 Van Brunt ..... F23H 3/02 110/328
2,505,915 A 5/1950 Salmi
(Continued)

FOREIGN PATENT DOCUMENTS

DE 195 02 261 A1 8/1995
DE 298 07 161 U1 9/1998
(Continued)

OTHER PUBLICATIONS

Sep. 8, 2020 Search Report issued in International Patent Application No. PCT/EP2020/068504.
(Continued)

*Primary Examiner* — David J Laux
(74) *Attorney, Agent, or Firm* — Oliff PLC

(57) ABSTRACT

A grate block for a combustion grate including a block body having an upper wall which forms a bearing surface and along which the combustible material is to be conveyed and a front wall which has a lower bearing edge, the bearing edge being designed to come into contact with the bearing surface of an adjacent grate block in a feed direction, wherein the upper wall has an air supply opening formed by an air supply channel. The air supply opening is at least partially surrounded by a thickened portion which protrudes from the bearing surface, forms a protective channel extending the air supply channel, and is designed to prevent liquid from flowing into the air supply opening.

12 Claims, 2 Drawing Sheets

(51) Int. Cl.
*F23H 7/08* (2006.01)
*F23H 17/12* (2006.01)

(56) References Cited

U.S. PATENT DOCUMENTS

| | | | | |
|---|---|---|---|---|
| 4,102,239 | A | 7/1978 | Dallas | |
| 4,876,972 | A * | 10/1989 | Mrklas | F23L 1/02 110/298 |
| 5,617,801 | A * | 4/1997 | Hauser | F23H 3/02 110/282 |
| 6,302,038 | B1 * | 10/2001 | Seo | F23H 17/00 126/152 A |
| 2014/0283718 | A1 * | 9/2014 | Penski | F23H 17/02 29/402.08 |
| 2014/0369785 | A1 | 12/2014 | Revel et al. | |
| 2018/0347811 | A1 * | 12/2018 | Brennwald | F23H 3/04 |
| 2021/0364164 | A1 * | 11/2021 | Martin | F23H 7/08 |

FOREIGN PATENT DOCUMENTS

| | | | |
|---|---|---|---|
| DE | 20 2017 006429 | U1 | 3/2019 |
| EP | 0 167 658 | A1 | 1/1986 |
| WO | 2016/198119 | A1 | 12/2016 |

OTHER PUBLICATIONS

Jan. 11, 2022 International Preliminary Report on Patentability issued in International Patent Application No. PCT/EP2020/068504.

* cited by examiner

Fig. 3
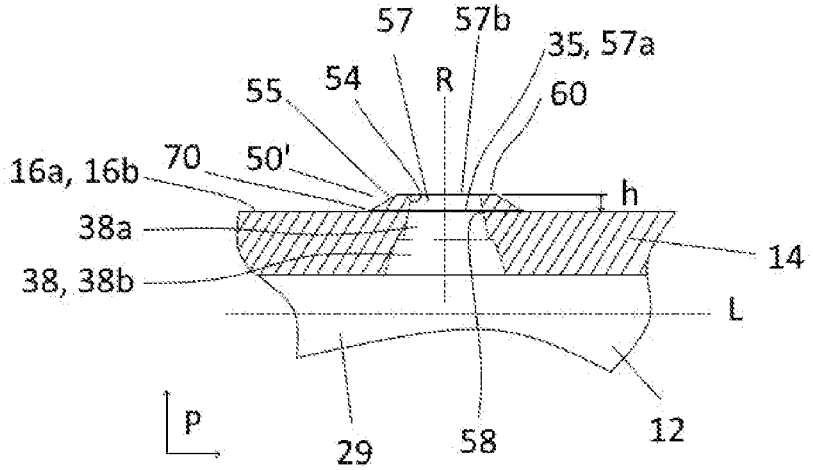
Fig. 4
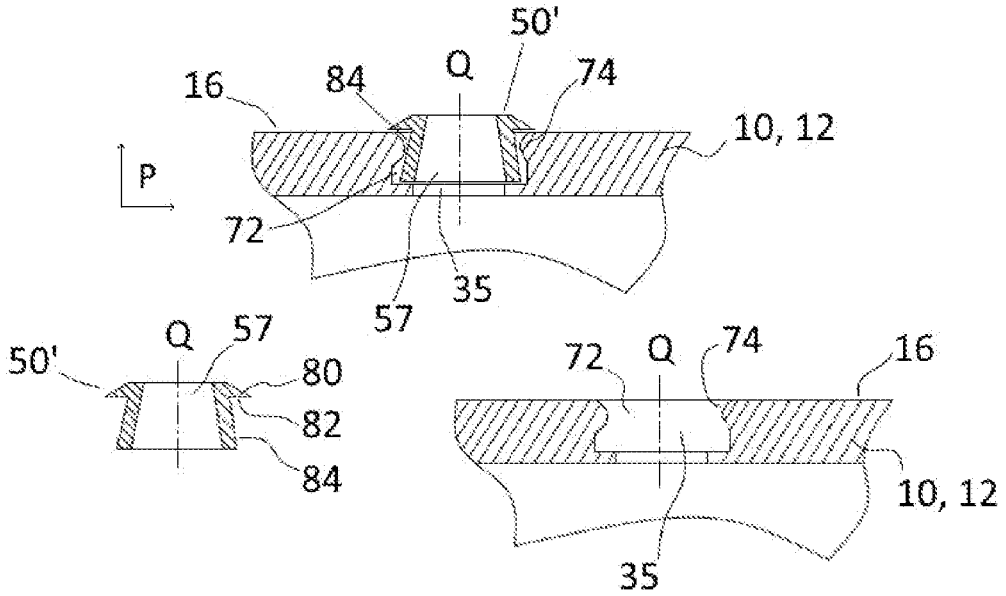
Fig. 5
Fig. 6

GRATE BLOCK FOR A COMBUSTION GRATE

The invention relates to a grate block for a combustion grate, according to the preamble of claim 1, and to a method for producing the same, according to the preamble of claim 12. The invention furthermore relates to a molded part for fastening to an upper wall of a grate block that forms the combustion grate.

The invention furthermore relates to a combustion grate comprising at least one such grate block and to the use of said combustion grate for the incineration of waste, as well as to a waste incineration plant comprising such a combustion grate.

Combustion grates for the large-scale incineration of waste have been known to the person skilled in the art for a long time. Such combustion grates can be, for example, in the form of thrust combustion grates, which include moving parts that are suitable for carrying out stoking strokes. The incinerator charge here is conveyed from an inlet-side end of the combustion grate to the outlet-side end of the latter and is incinerated during this time. In order to supply the combustion grate with the oxygen required for combustion, corresponding air supply lines which pass through the combustion grate and through which the air, also called primary air, is introduced, are provided.

A frequently used combustion grate is the so-called step grate. The latter comprises grate blocks which are disposed next to one another and form in each case a row of grate blocks. The rows of grate blocks here are disposed on top of one another in the manner of steps, wherein in so-called moving grates the front end of a grate block, when viewed in the thrust direction, bears on a bearing face of the grate block adjacent in the transport direction and in the event of a corresponding thrust movement is moved on this bearing face.

In the case of so-called reversing grates, the grate blocks are disposed so as to be rotated by approximately 180° in relation to the moving grates, when viewed in the transport direction of the incinerator charge. Therefore, in the case of reversing grates, the front end of the grate block, when viewed in the thrust direction, bears on a bearing face of the respective preceding grate block. In contrast to moving grates, the thrust direction in the case of reversing grates is thus opposite to the transport direction, the latter resulting from the inclination of the reversing grate.

A combustion grate which comprises a plurality of rows of grate bars which, when viewed in the transport direction of the incinerator charge, are disposed one behind the other in the manner of steps, is disclosed in DE 195 02 261 A1. Furthermore, the combustion grate comprises support grate bars which have a shape similar to the grate bars and are shortened in accordance with the length of a nozzle plate. In one embodiment, the nozzle plate can be configured by a hollow nozzle box in which, when viewed in the transport direction of the incinerator charge, a plurality of rows of air nozzles, in particular vortex nozzles, are integrated in the end side and in the front, upper portion. The configuration of the vortex nozzles is not discussed in more detail. The nozzle plate is provided with a device by way of which the former can be hooked onto the support grate bar. A so-called vortex nozzle grate path is formed by several support grate bars and nozzle plates hooked onto the support grate bars and can run across the width of the combustion grate. The vortex nozzle grate path can be impinged with compressed air and vortex air independently of a primary air system of the combustion grate. The fuel or slag layer is torn open and recirculated by a pulsed compressed air supply. The recirculation achieved leads to a loosening of the fuel on the grate, as a result of which an improved burnout of incompletely combusted fuel particles is made possible. Furthermore, the compressed air pulses cause the nozzle plates to self-clean, since fuel or ash particles that have penetrated the air nozzles are blown out again.

A grate bar for a combustion grate is disclosed in DE 20 2017 006429 U1, wherein the combustion grate comprises a plurality of rows of grate bars which, when viewed in the transport direction of the incinerator charge, are disposed one behind the other in the manner of steps. The grate bar comprises a front foot portion and an upper running surface for the front foot portion of a grate bar of a row of grate bars disposed at a higher level. The running surface has a contour structure with an elevation and/or depression for deflecting the grate bar of the row disposed at a higher level during the advancing movement of the rows of grate bars of the combustion grate. However, the provision of air supply openings in the grate bars is not discussed in this document.

A grate plate made of cast steel for transporting and cooling, heating, drying or incinerating bulk material, which has troughs disposed in a grid shape on the upper side of said grate plate, is disclosed in DE 298 07 161 U1. Air passage holes are disposed in the troughs. The configuration of the opening of the air passage holes in the troughs, i.e. in a plane which lies below the plane of the upper side of the grate plate, makes use of the findings that the larger pieces of material in the bulk material move across the upper side of the grate plates without impacting the peripheries of the air passage holes. Moreover, after a certain time, a thin layer of fine material settles, which acts as a cushion so that the edges of the air passage holes are spared, in the troughs. Thus, the passage of air is ensured for a long time without the requirement of inspecting the grate plates.

Grate blocks are exposed to very high thermal load, mainly because of the high temperatures during combustion, or in the combustion chamber. During the normal operation of the combustion grate, this thermal load becomes high, in particular in the region of an upper wall of the grate block which forms the bearing face and along which the incinerator charge is conveyed, and of a front wall of the grate block which forms a thrust surface for pushing the incinerator charge.

Very high loads arise when the incinerator charge is unevenly distributed on the combustion grate and only a thin, heat-insulating layer of incinerator charge is formed locally or is completely absent. This thermal load promotes erosion as a result of abrasion and chemical reactions taking place on the bearing face, this further damaging the bearing face. This ultimately leads to a reduction in the service life of the grate block.

For cooling a grate block and for supplying air to the combustion grate, air supply ducts forming air supply openings can be formed in the upper wall and/or in the front wall.

In particular, the air supply duct formed in the upper wall can become clogged by the incinerator charge and/or by combustion residues, so that the air supply for cooling the grate block and for promoting the combustion of the incinerator charge no longer takes place in an efficient manner. This ultimately leads to increased maintenance costs and a reduced operating life of the grate block.

Furthermore, the incinerator charge contains materials which can at least partially become liquid during combustion, for example metals, plastics or tars. In the present application, the term “fraction” of the incinerator charge relates to these materials contained in the incinerator charge, and the fraction in the liquid state is referred to as the "liquid fraction".

The liquid fraction can also flow into the air supply duct and lead to the impairment of the air supply, in particular in the case of an air supply duct configured in the upper wall. In the solidified state, this fraction can even lead to a permanent blockage of the air supply duct.

EP 0 167 658 A1 discloses a grate block for building a combustion grate which comprises a block body configured in the manner of a box. The block body has an upper wall forming a bearing face for the incinerator charge, wherein the upper wall has air supply openings formed by air supply ducts for introducing gas, in particular air, into the incinerator charge and for cooling the grate block. In one embodiment, the air supply openings are configured as slots and, when viewed in cross section, at their gas inlet in the manner of a syphon curved counter to gravity, so as to form an obstacle to the ingress and penetration by the incinerator charge or combustion residues through the air supply openings. As a result of the upper wall having air supply ducts, said upper wall can be cooled. However, the disclosed design of the air supply ducts facilitates an accumulation of incinerator charge in the liquid state in the air supply ducts.

The object to be achieved according to the invention is to provide a grate block mentioned at the outset in which, in operation, the risk of the air supply through the air supply ducts being impaired is minimized.

This object is achieved by the grate block defined in independent claim 1.

Preferred embodiments of the grate block according to the invention are reflected in the dependent claims.

According to claim 1, the present invention thus relates to a grate block for a combustion grate, in which successive grate blocks are disposed on top of one another in the manner of steps and, by means of thrust movements carried out relative to one another, are designed in a manner so as to shift and convey the incinerator charge during the incineration. In a known manner, these thrust movements can be carried out, for example, by means of relative movements between grate blocks of different steps of the combustion grate. As mentioned at the outset, such combustion grates are also referred to as step grates.

Furthermore, the grate block comprises a block body which is preferably configured as a casting. The block body is typically configured so as to be substantially in the form of an elongated cuboid with a longitudinal axis L.

The block body comprises an upper wall which forms a bearing face along which the incinerator charge is to be conveyed and which defines an incinerator charge side of the upper wall. When viewed in a thrust direction S, the foremost end of the bearing face forms an edge by way of which the bearing face descends into a thrust surface formed by a front wall.

The side of the upper wall that faces away from the bearing face and the side of the front wall that faces away from the thrust surface define a cooling air side of the block body.

Furthermore, the front wall in the lowermost region thereof is configured in the form of a foot which is specified for bearing on the bearing face of a grate block adjacent in the thrust direction S.

In one preferred embodiment, in which the grate block according to the invention is specified for an advancing grate, the foot thus bears on the grate block that follows in the transport direction T of the incinerator charge, or the bearing face of the latter. It is also conceivable, however, that the grate block according to the invention is specified for a reversing grate; in this case, the foot bears on the grate block, or the bearing face thereof, that is preceding in the transport direction T of the incinerator charge.

The thrust direction S identifies the direction in which the incinerator charge is pushed by the thrust surface of the grate block. The thrust direction S typically is parallel to the longitudinal axis L.

The transport direction T identifies the direction of movement of the incinerator charge from an inlet toward an outlet of the combustion grate. The transport direction T is derived mainly from the inclination of the combustion grate.

At least the front bearing edge of the thrust surface is disposed in a plane E running substantially orthogonally to the longitudinal axis L. In this context, it is conceivable that a surface disposed in the lowermost area of the front wall, the lower end of said surface being formed by the front bearing edge, is disposed in the plane E. However, it is also conceivable that only the line defined by the front bearing edge is disposed in the plane E.

Furthermore, the upper wall has an air supply opening which is formed by an air supply duct extending through the upper wall. In the context of the present application, the air supply opening is also to be understood to be an air supply outlet. As a result, an optimal air supply to the combustion grate or to the combustion bed on the combustion grate is obtained, this contributing to a very high burnout of the incinerator charge.

In the following, the term "air" includes the so-called primary air which is supplied to the combustion grate or the combustion bed on the combustion grate. The primary air primarily contributes to the burnout of the incinerator charge but at the same time also to the cooling of the grate blocks of the combustion grate.

The front wall can have a further air supply opening which is formed by further air supply ducts which, when viewed in longitudinal section, run orthogonally or obliquely to the thrust surface, for supplying air to the combustion grate. This also facilitates the burnout of the incinerator charge.

According to the invention, the air supply opening is at least partially surrounded by a thickening which projects from the bearing face. The thickening forms a protection duct which extends the length of the air supply duct and is specified to prevent liquid flowing into the air supply opening. The incinerator charge can specifically contain a fraction which can at least partially become liquid during combustion, as has already been explained above, and can flow into the air supply duct. Consequently, the air supply is impaired, so that the combustion of the incinerator charge and the cooling of the grate block do not proceed efficiently. The provision of the thickening according to the invention leads to the liquid fraction flowing about the thickening instead of penetrating into the air supply duct. The risk of a blockage of the air supply duct can thus be reduced. In particular, clogging of the air supply duct by the fraction in the solidified state can be reduced.

The air supply opening is preferably completely surrounded by a thickening projecting from the bearing face. This means that the thickening forms a continuous border about the air supply opening. The flow of the liquid fraction into the protection duct and then into the air supply duct can thus be at least almost avoided.

The protection duct is enclosed by an inner flank of the thickening. Furthermore, the thickening has an outer flank which adjoins the inner flank and runs in a descending manner on the side that faces away from the protection duct.

The outer flank thus corresponds fundamentally to the outer region of the thickening that is exposed to the incinerator charge. In this context, the term "flank" defines a lateral, optionally inclined, thickening wall.

The protection duct, on the end of the protection duct that faces the bearing face, comprises a lower protection duct opening and, on the end of the protection duct that faces away from the bearing face, i.e. on the side of the thickening that faces the incinerator charge, an upper protection duct opening.

In one embodiment, the inner flank can be configured so as to be adjacent to the air supply opening, i.e. the lower protection duct opening surrounds the air supply opening. The term "adjacent" is to be understood such that a region of the bearing face about the air supply opening can be present between the air supply opening and the inner flank. Such an arrangement can arise, for example, after a repair, when a replacement thickening is welded about the air supply opening, as will be explained hereunder, wherein the available opening of the protection duct of the replacement thickening is wider than the available opening of the protection duct of the previous thickening. In this respect, however, it should be noted that the protection duct, by way of the widening thereof, in this embodiment forms a kind of collecting area for the incinerator charge and the incineration residues. In order to keep this effect within limits, the contour of the lower protection duct opening advantageously runs as close as possible to the contour of the air supply opening.

The inner flank is particularly preferably configured so as to be directly adjacent to the periphery of the air supply opening. In other words, the inner flank begins directly at the periphery of the air supply opening, so that the lower protection duct opening corresponds to the air supply opening. The widening of the protection duct can thus be reduced and the inherently undesirable collecting effect of the incinerator charge about the air supply opening can be minimized. This facilitates efficient cooling of the grate block by reducing the blockages.

In one preferred embodiment, the thickening is configured in the form of a bead and thus in a curved manner. As a result of the curved configuration of the wall thickening it is ensured that the incinerator charge can be transported without impediment across the grate block, i.e. without tilting due to angular unevennesses.

In one preferred embodiment, the air supply duct has a slot-shaped air supply opening which is aligned in the longitudinal direction of the grate block. The width of the air supply opening here is chosen in such a manner that the slag resulting from the combustion of the incinerator charge and the combustion residues drop through the air supply duct and cause a blockage to the least possible extent. Reliable cooling of the grate block can thus be guaranteed.

In one preferred embodiment, a transition region of the thickening, which extends between the inner flank and the outer flank, is flattened or radiused. This configuration of the thickening reduces the risk that the incinerator charge is blocked by an angular region of the thickening during transport on the combustion grate and completely or partially blocks the air supply duct. This also facilitates efficient cooling of the grate block.

In the following, the term "cross section" is to be understood as a section in a plane running orthogonally to the bearing face.

In one preferred embodiment, the inner flank, when viewed in cross section, at least in a lower region of the inner flank that faces the bearing face, runs at least approximately orthogonally to the bearing face. As a result, the widening of the protection duct is further reduced so that the collecting effect is reduced and ultimately less of the incinerator charge can accumulate in the protection duct. Consequently, the air supply through the air supply duct can be improved.

The inner flank, at least approximately across the total height of the inner flank, preferably runs orthogonally to the bearing face. In this embodiment, the available cross section of the protection duct is at least approximately the same as the air supply opening. The risk of the incinerator charge accumulating in the protection duct can thus be minimized, as the upper protection duct opening defines the narrowest point of the protection duct.

In one preferred embodiment, the cross section of the protection duct is configured so as to widen, in particular continuously widen, in the direction from the end of the protection duct that faces away from the bearing face to the bearing face. This configuration of the protection duct enables the combustion residues that have entered the protection duct to be easily discharged. This is because said combustion residues are pressed further by the incinerator charge situated on the grate block in the direction of the cooling air side into the protection duct and released because of the widening of the protection duct. A blockage of the air supply can thus be avoided.

In one preferred embodiment, the cross section of the air supply duct widens, in particular continuously, in the direction away from the bearing face. Should the incinerator charge, in particular slag, nevertheless flow into the air supply duct, this embodiment has the advantage that the widening allows the incinerator charge to flow away more easily, as already explained in connection with the protection duct. A blockage of the air supply duct can thus be avoided and an efficient air supply, that is to say in particular the efficient cooling of the grate block, can be guaranteed.

In one preferred embodiment, the cross section of the air supply duct and/or of the protection duct widens in the form of a cone, wherein the surface line of the cone forms an angle of 10 degrees to 30 degrees in relation to a direction R running orthogonally to the bearing face. The angle is preferably 15 degrees. This embodiment has the further advantage that it can be produced in a simple manner, in particular by a casting method.

In one preferred embodiment, the outer flank, when viewed in cross section, extends so as to widen, in particular continuously, in the direction from the end region of the thickening that faces away from the contact surface to the contact surface. The basic shape of the thickening is thus reminiscent of a volcano. This shape means that the thickening does not form any significant unevenness on the surface of the grate block, which could act as an obstacle to the incinerator charge.

In one preferred embodiment, the outer flank, when viewed in the cross section, runs in a curved manner. This configuration facilitates the drainage of the liquid fraction about the thickening. The risk of the liquid fraction being partially blocked by the outer flank can thus be reduced. According to this embodiment, specifically the risk of causing an accumulation of the liquid fraction outside the thickening, which could be pushed beyond the thickening by the incinerator charge moving in the transport direction and could ultimately flow into the air supply opening, can be counteracted.

The outer flank preferably runs so as to be concave or convex at least approximately in the manner of a quadrant. This shape enables a particularly simple production of the thickening.

In one preferred embodiment, the outer flank runs so as to be at least approximately rectilinear. This shape also enables the thickening to be produced in a particularly simple manner, in particular in the case of a casting method.

The outer flank, when measured in the cross section, preferably forms an angle of 20 degrees to 45 degrees, particularly preferably 30 degrees, in relation to the bearing face. This angular range means that the thickening does not form any significant unevenness on the surface of the grate block, which could act as an obstacle to the incinerator charge.

In one preferred embodiment, the thickening has substantially the shape of a hollow truncated cone, preferably having an elliptical base area. This embodiment offers an optimal configuration which at the same time reduces the risk of an accumulation of liquid fraction in the region of the thickening, and enables a simple construction, in particular for volume production.

In one preferred embodiment, the thickening, when viewed in a plane A running parallel to the bearing face, has a U-shape or V-shape, wherein the opening of the U-shape or the V-shape is aligned in the transport direction T. In this embodiment, the incinerator charge that has accumulated in the protection duct can be pushed further downstream through the opening of the U-shape or the V-shape without impediment and conveyed in the transport direction T by the incinerator charge moving in the transport direction. Moreover, the thickening allows the liquid fraction situated upstream of the U-shaped or of the V-shaped thickening to flow away laterally about the thickening, when viewed in the transport direction T.

In one preferred embodiment, the arms of the U-shape or V-shape of the thickening, when viewed in the transport direction T, extend at least as far as a periphery of the air supply opening that is located furthest upstream.

In one preferred embodiment, the height of the thickening, when measured from the bearing face, is 5 mm to 30 mm.

This height of the thickening allows an efficient diversion of the liquid fraction about the thickening, so that said liquid fraction does not flow into the air supply duct by way of the thickening. The height of the thickening is preferably 10 mm, so that the conveyance of the incinerator charge is not additionally impaired by the height of the thickening. Thus, the thickening does not form any significant unevenness on the surface of the grate block, which could act as an obstacle for the incinerator charge. At the same time, it is ensured that the thickening is not abraded prematurely by the incinerator charge. The service life of the grate block can thus be optimized.

In one preferred embodiment, the air supply opening is configured in that section of the upper wall that, when viewed in the thrust direction S, projects from the end position of a thrust movement of the grate block that precedes in the transporting direction T. As a result, air is supplied to the combustion grate or to the combustion bed on the combustion grate, this facilitating the burnout of the incinerator charge.

In one preferred embodiment, the thickening is in the form of a molded part, and the thickening is welded to the grate block. Thus, a conventional grate block, i.e. a grate block without a thickening, can be equipped with a thickening if required. This embodiment thus allows a flexible design of the grate blocks of a combustion grate if only individual grate blocks have to be equipped, for example in a region of the combustion grate.

In one preferred embodiment, the thickening is in the form of a molded part and is mechanically fastened to the grate block. This embodiment also enables fastening by a craftsman who does not have any special welding qualifications. Furthermore, the mechanical fastening is easily releasable and the thickening can be released again without special machining of the block body, for example without grinding the weld seam.

In the present context, mechanical connections comprise form-fitting and/or force-fitting connections and differ from materially integral connections such as welding.

In one preferred embodiment, the thickening is formed so as to be integral to the grate block. The term "integral" is to be understood such that the thickening and the grate block form a single block, which can be produced, for example, by casting, no seam being present. A cost-effective production is thus possible.

For the sake of completeness, it should be mentioned that several air supply ducts extending through the upper wall can be provided, and may be provided with a thickening.

This also applies to the front wall, which can likewise have further air supply ducts that can be surrounded by a thickening. As a result, an optimal air supply to the combustion grate or to the combustion bed on the combustion grate is obtained, this contributing to a very high burnout of the incinerator charge.

According to a further aspect, the present invention moreover relates to a combustion grate comprising at least one of the grate blocks described above.

Furthermore, the present invention relates to the use of a combustion grate described above for the incineration of waste and to a waste incineration plant comprising such a combustion grate.

Another aspect of the invention relates to a molded part for fastening to an upper wall of a block body of a grate block about an air supply opening which is configured in the upper wall and formed by an air supply duct extending through the upper wall, wherein the grate block is specified for a combustion grate and the block body is configured as a casting, wherein the upper wall forms a bearing face along which the incinerator charge is to be conveyed, wherein the molded part, in the fastened state, forms a thickening that projects from the bearing face, surrounds the air supply opening, forms a protection duct which extends the air supply duct and is specified for preventing liquid flowing into the air supply opening, wherein the protection duct is enclosed by an inner flank of the thickening, that is to say of the molded part, and the thickening has an outer flank that adjoins the inner flank and runs in a descending manner on the side that faces away from the protection duct.

Furthermore, the protection duct of the molded part comprises an upper protection duct opening which, viewed in the fastened state of the molded part, is disposed on the side of the molded part that faces the incinerator charge, i.e. on the end of the protection duct that faces away from the bearing face, and a lower protection duct opening disposed on the side that faces away from it.

On the side of the molded part that faces away from the incinerator charge, the molded part has a base penetrated by the protection duct, the outer base area of which, in the fastened state of the molded part, runs at least approximately flush with the plane of the bearing face.

In one preferred embodiment, the molded part is specified to be welded about the air supply opening which is formed in the upper wall of the block body of the grate block. The method for fastening the molded part is thus carried out by welding to the upper wall. It should also be mentioned here that the welding can take place on the side of the upper wall that faces the incinerator charge or on the side of the upper wall that faces away from the incinerator charge. This ensures an at least approximately airtight connection between the molded part and the block body, so that the air supply to the incinerator charge is performed in a controlled manner.

In one preferred embodiment, the molded part is mechanically fastened to the upper wall of the block body. This embodiment allows simple fastening without any special knowledge of welding. Furthermore, the mechanical fastening is easily releasable and the molded part can be released again without special processing of the block body, for example without grinding off the weld seam.

It is also conceivable to configure the molded part in such a manner that it is first mechanically fastened using a fastening means in a first step and then by welding in a second step. This embodiment has the advantage that the welding can take place particularly efficiently because the molded part is already held in its use position by the fastening means without any further aids.

The grate block is specified for a combustion grate and can be configured as a casting.

In one preferred embodiment, the molded part is also configured as a casting. Such molded castings are particularly advantageous from an economic point of view, since they can be produced in a cost-effective manner. In addition, a mechanical connection is favorable in this embodiment because it does not require casting-to-casting welding.

In one preferred embodiment, the molded part is produced from a different material than the material of the block body. The grate block thus comprises a first material for the block body and a second material, which differs from the first material, for the molded part. A selection of different materials for the block body and for the molded part can take into account different stress on the block body and the molded part, e.g. different wear, different operating temperatures or different configuration features such as geometry or mechanical properties, to name just a few examples. Furthermore, different production methods can also be considered, so that their production can be optimized independently of one another.

Materials such as steel, corrosion-resistant chrome steel and heat-resistant steel, which can be machined, for example, by milling, are particularly suitable for the molded part. These materials in turn enable the production of more complex geometries of the molded part than is the case with a cast molded part.

In one preferred embodiment, the molded part is produced from a harder material than the material of the block body. This has the advantage that the maintenance of the grate block can be carried out at longer intervals by virtue of a molded part that is less subject to wear.

In one preferred embodiment, the cross section of the protection duct widens in the direction from the upper protection duct opening to the lower protection duct opening, and in particular is configured to widen continuously. As already mentioned above, this configuration of the protection duct enables the combustion residues that have entered the protection duct to be easily discharged.

In one preferred embodiment, the molded part substantially has the shape of a hollow truncated cone, preferably having an elliptical base area. This embodiment offers an optimal configuration, which at the same time reduces the risk of an accumulation of liquid fraction in the region of the thickening. In addition, a simple construction, in particular for volume production, is made possible.

Fastening means, for example a screw, which do not belong to the molded part, are conceivable as fastening means for fastening the molded part.

In one preferred embodiment, the molded part comprises the fastening means, which is configured in such a manner that the mechanical fastening takes place by means of a form-fitting connection to the upper wall, for example by pressing the molded part into a recess in the upper wall.

In one preferred embodiment, the molded part comprises the fastening means, which is configured in such a manner that the mechanical fastening is carried out by a force-fit connection to the upper wall, for example by clamping the molded part in a recess in the upper wall.

A combination of these fastening methods is possible.

In one preferred embodiment, the fastening means projects in the form of a protrusion from the base of the molded part, in the direction away from the side of the molded part that faces the incinerator charge, i.e. in the fastened state in the direction of the grate block. The protrusion is specified to be at least partially received in the recess and held by a mechanical connection, for example by a form-fitting and/or force-fitting connection.

A form-fitting connection can be produced, for example, in that the protrusion is introduced into the recess, the recess having a tapering portion, i.e. a constriction, and the protrusion having a widening portion. The largest cross section of the widening portion here is of larger dimension than the smallest cross section of the constriction, in such a manner that the widening portion of the protrusion can be pressed in through the constriction and the protrusion is thereby held in a clamped manner.

In one preferred embodiment, the protrusion has a thread and the recess has a threaded receptacle, so that the protrusion can be screwed into the recess.

Form-fitting and force-fitting fastening methods have the advantage that they can be carried out easily and enable the molded part to be fastened to the grate block in a robust manner.

Optionally, the protrusion can enclose and lengthen the protection duct.

The protrusion is configured in such a manner that, in the fastened state in which the protrusion is received in the recess, the protection duct of the molded part and the air supply duct of the block body are fluidically connected.

In the fastened state, be it in the welded or in the mechanically fastened state, the molded part forms a thickening which offers a solution for reducing the risk of impairment of the air supply through the air supply ducts, as explained above in connection with the thickening according to the invention.

In this context, this molded part also allows a flexible design of the grate blocks of a combustion grate, because only individual grate blocks can be equipped, for example, in a region of the combustion grate.

Furthermore, the molded part can be used to replace a thickening that was previously configured on the grate block and surrounds the air supply opening, preferably according to the above disclosure, when said thickening is worn out. This helps to reduce the maintenance costs because the entire grate block does not have to be replaced.

Optionally, the molded part can also be used if the air supply opening of the grate block has been damaged by the operation of the combustion grate and the periphery of the air supply opening has been worn away, for example in areas. The molded part can be welded or mechanically fastened in such a manner that it covers this damaged area so that the grate block can be reinserted.

In one preferred embodiment, the grate block is specified for a combustion grate in which successive grate blocks are disposed one above the other in a step-like manner and are designed in such a manner that the incinerator charge can be shifted and conveyed during the combustion by means of pushing movements performed relative to one another. Furthermore, when viewed in a thrust direction S aligned substantially parallel to the longitudinal axis L, the foremost end of the bearing face forms an edge over which the bearing face drops into a thrust surface formed by a front wall. Furthermore, the front wall has a lower bearing edge which is disposed in a plane E running substantially orthogonally to the longitudinal axis L and which is specified to come into contact with the bearing face of a grate block adjacent in the thrust direction S.

Another aspect of the invention relates to a method for producing a grate block according to the above disclosure, wherein a) a block body configured as a casting, having an upper wall and defining a longitudinal axis L is provided, wherein the upper wall forms a bearing face along which the incinerator charge is to be conveyed and the foremost end of which, when viewed in a thrust direction S, aligned substantially parallel to the longitudinal axis L, forms an edge by way of which the bearing face descends into a thrust surface formed by a front wall, the front wall has a lower bearing edge which is disposed in a plane E running substantially orthogonally to the longitudinal axis L and specified for coming into contact with the bearing face of a grate block adjacent in the thrust direction S, wherein the upper wall has an air supply opening formed by an air supply duct running through the upper wall, and the bearing face about the air supply opening is configured so as to be substantially planar, and b) the thickening is welded or mechanically fastened about the air supply opening.

The planar configuration of the bearing face has the advantage that the thickening sits stably on the grate block before fastening, so that the fastening work is simplified. However, it is also possible to configure the bearing face about the air supply opening to be complementary to the geometry of the side of the thickening that faces the bearing face, for example in order to simplify mechanical fastening.

In one preferred embodiment, the thickening is formed by the molded part disclosed above. The grate block thus comprises the block body and the thickening or the molded part.

In this context, the advantages of this method are derived from the above disclosure relating to the corresponding thickening or the corresponding molded part.

Another aspect of the invention relates to a method for producing a grate block according to the above disclosure, wherein a replacement thickening after abrasion of at least 50%, preferably of at least 80% of the height of the thickening, caused by the operation of the grate block, for restoring the thickening is welded or mechanically fastened. The replacement thickening is welded or mechanically fastened about the air supply opening, preferably on the site of the previous thickening. This process enables the grate block to be retrofitted, so there is no need for a new one.

In one preferred embodiment, the replacement thickening is formed by the molded part disclosed above.

The invention will be illustrated by means of the appended figures, in which:

FIG. 3 shows a detail of the grate block according to FIG. 1 in the longitudinal section through the sectional plane II-II shown in FIG. 1, wherein the thickening is welded to the grate block;

FIG. 4 shows a detail of a further grate block according to the invention in the longitudinal section, wherein a molded part is mechanically fastened to an upper wall of the grate block;

FIG. 5 shows a longitudinal section of the molded part according to FIG. 4 without a grate block; and FIG. 6 shows a longitudinal section of the upper wall of the grate block according to FIG. 4 without a molded part.

Figure 1:
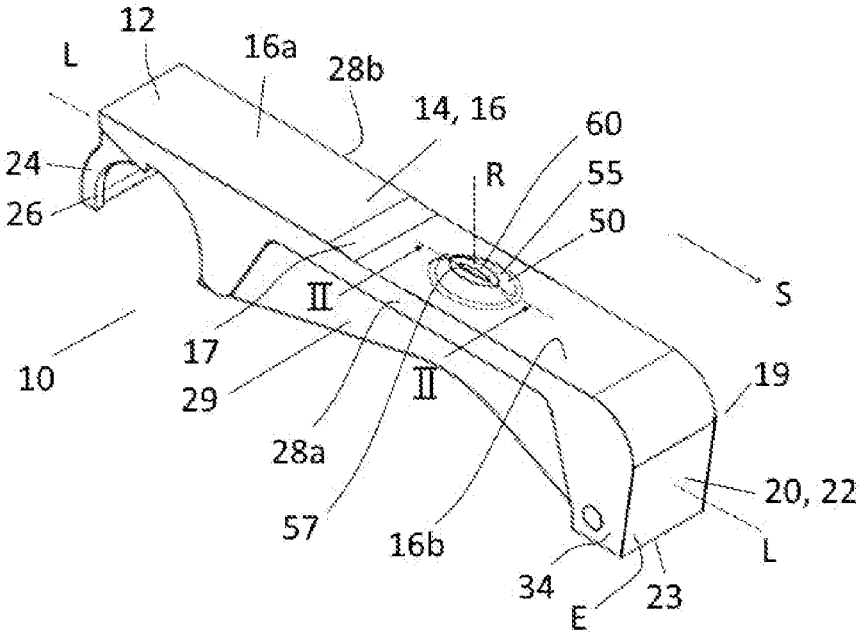
FIG. 1 shows a grate block according to the invention in a perspective view.

As can be seen from FIG. 1, the grate block 10 comprises a block body 12 configured as a casting, which is configured substantially in the form of an elongate cuboid with a longitudinal axis L.

The block body 12 comprises an upper wall 14, which forms a bearing face 16 running parallel to the longitudinal axis L, along which the incinerator charge is to be conveyed and the foremost end of which, when viewed in the thrust direction S, forms an edge 19, over which the bearing face 16 descends into a thrust face 22 formed by a front wall 20.

In the embodiment shown, the bearing face has a first bearing face region 16*a* and a second bearing face region 16*b*, both of which run parallel to the longitudinal axis L, but the first bearing face region 16*a* is disposed offset upward from the second bearing face region 16*b* and connected via a beveled transition 17 to the latter.

On the side opposite the front wall 20, the block body 12 has a rear wall 24 which is equipped with at least one hook 26 with which the grate block 10 can be hooked into a block mounting tube. A central web 29 is also disposed on the underside of the grate block 10 that faces away from the bearing face 16.

Laterally, the grate block 10 is in each case closed off by a lateral wall 28*a*, 28*b* extending in the longitudinal direction L.

Within the combustion grate, the grate block 10 bears on a grate block that follows in the thrust direction S. For this purpose, the lowermost area of the front wall 20 is configured in the form of a block 34, which is specified to rest on the bearing face of a grate block adjacent in the thrust direction S. The lowermost area including a front bearing edge 23 of the thrust surface formed by said lowermost area is disposed in a plane E which runs substantially orthogonally to the longitudinal axis L.

Figure 2:
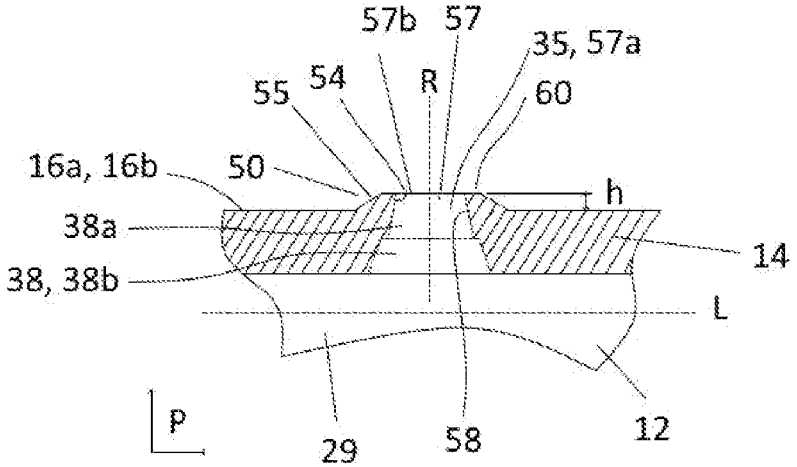
FIG. 2 shows a detail of the grate block according to FIG. 1 in the longitudinal section through the sectional plane II-II shown in FIG. 1, wherein the thickening is configured so as to be integral to the grate block.

As can be seen from FIG. 2, the upper wall 14 also has an air supply opening 35 which is formed by an air supply duct 38 extending through the upper wall 14. Primary air is supplied to the combustion grate or the combustion bed on the combustion grate through the air supply duct 38.

In the embodiment shown, the air supply duct 38 forms a slot-shaped air supply opening 35 in the upper wall 16, which is aligned in the longitudinal direction of the grate block 10, and the air supply duct 38 defines a longitudinal plane of symmetry P. In FIG. 2, the section plane II-II runs in the longitudinal plane of symmetry P.

The air supply duct 38 extends concentrically to an axis R running orthogonally to the bearing face 16 and in the longitudinal plane of symmetry P, the available opening of the air supply duct 38 being substantially elliptical and expanding continuously in the direction away from the bearing face 16 in the form of a cone. The air supply duct comprises a first air supply duct portion 38*a* that faces the bearing face 16 and a second air supply duct portion 38*b* adjoining the first air supply duct portion 38*a* on its side that faces away from the bearing face, wherein the widening of the second air supply duct portion 38*b* is greater than the widening of the first air supply duct portion 38*a*. With respect to the axis R, the generatrix of the cone forms a first angle of 10 degrees in the first air supply duct portion 38*a* and a second angle of 15 degrees in the second air supply duct portion 38*b*.

Furthermore, the air supply opening 35 is completely surrounded by a thickening 50 projecting from the bearing face 16. The thickening 50 forms a protection duct 57, which extends the air supply duct 38, and is specified to prevent liquid flowing into the air supply opening 35.

The protection duct 57 comprises a lower protection duct opening 57*a* on the end of the protection duct 57 that faces the bearing face 16 and an upper protection duct opening 57*b* on the end of the protection duct 57 that faces away from the bearing face 16, i.e. on the side of the thickening that faces the incinerator charge.

Furthermore, the protection duct 38 is enclosed by an inner flank 54 of the thickening 50, wherein the inner flank 54 is configured so as to be directly adjacent to a periphery of the air supply opening 58 running in the bearing face. In addition, the thickening 50 has an outer flank 55 which adjoins the inner flank 54, descends on the side that faces away from the protection duct 38 and runs in a rectilinear manner. A flattened transition region 60 of the thickening 50 also extends between the inner flank 54 and the outer flank 55. In the embodiment shown, the height h of the thickening, when measured from the bearing face, is approx. 20 mm. In addition, the inner flank, when viewed in cross section, runs at least approximately in the extension of the lateral surface of the first air supply duct portion 38*a*.

In FIG. 2, the thickening 50 in a casting method is formed so as to be integral to the grate block 10.

In FIG. 3, the grate block according to FIG. 1 is shown, wherein the thickening is formed by a molded part 50' and welded to the grate block 10. Accordingly, the grate block 10 has a weld seam 70 at the interface between the molded part 50' and the bearing face 16. The molded part 50' has substantially the shape of a truncated cone which has an elliptical base area and which extends concentrically to the axis R. Furthermore, the molded part 50' comprises a protection duct 57 which extends concentrically to the axis R and is specified to extend the length of the air supply duct 38. The protection duct 57 is configured in such a manner that its inner flank 54 runs in the extension of the lateral surface of the air supply duct 38.

The other features of the detail of the grate block 10 shown in FIG. 3 are similar to those in FIG. 2 and can be derived from the corresponding description.

In operation, the grate blocks 10 are moved relative to one another by means of the block mounting tubes. Depending on whether the block mounting tubes are assigned to a stationary or a movable grate block, the block mounting tubes are either attached to stationary consoles or to consoles which are disposed in a movable grate carriage.

Driving takes place by hydraulic cylinders which move the grate carriages back and forth over rollers on corresponding running surfaces.

Due to the relative movement obtained in this way, the foot 34 of a first grate block 10 is pushed back and forth over the bearing face 16 of the respectively subsequent grate block 10, wherein the incinerator charge is conveyed over the bearing face 16 before said incinerator charge is dropped over the edge 19 onto the bearing face 16 of the subsequent grate block 10.

Illustrated in FIG. 4 is a detail of a grate block 10 according to the invention, wherein the thickening is formed by a molded part 50' and mechanically fastened to the grate block 10. The grate block 10 comprises a block body 12 which in terms of construction has the same features as the grate block of FIG. 1. Only the differences will be described in more detail hereunder and the same parts are identified by the same reference symbols.

The block body 12 has a recess 72 extending about the air supply opening 35. In the present case, the air supply opening 35 and the recess 72 are configured to be rotationally symmetrical about an axis Q running orthogonally to the bearing face 16 and defined by the air supply opening 35. The recess 72 has a tapering section, i.e. a constriction, in the form of a lip 74, which adjoins the bearing face 16.

The molded part 50' has substantially the shape of a hollow truncated cone having an elliptical base area, as can be seen in FIGS. 4 and 5. On the side of the molded part that faces away from the incinerator charge, the molded part has a base 80 penetrated by the air supply duct, the outer base area 82 of which coincides with the base area of the truncated cone. In the embodiment shown in FIG. 4, in the fastened state of the molded part, the outer base area 82 runs at least flush with the plane of the bearing face 16.

Furthermore, the molded part 50' comprises a fastening means in the form of a protrusion 84, which projects from the base 80 of the molded part, in the direction away from the side of the molded part that faces the incinerator charge. The protrusion 84 is frustoconical and rotationally symmetrical to the axis Q. The protrusion 84 is specified to be received in the recess 72 and held by a mechanical connection.

For this purpose, the largest cross section of the widening section of the protrusion 84 is of larger dimension than the smallest cross section of the constriction 74, in such a manner that the protrusion 84 can be pressed and inserted into the recess 72. As a result, the protrusion 84 remains clamped in the recess 72.

LIST OF REFERENCE SIGNS

Grate block 10
Block body 12
Upper wall 14
Bearing face 16
Bearing face region 16*a*, 16*b*
Transition 17
Edge 19
Front wall 20
Rear wall 24
Hook 26
Lateral wall 28*a*, 28*b*
Central web 29
Block 34
Air supply opening 35
Air supply duct 38
First and second air supply duct portion 38*a*, 38*b*
Thickening or molded part 50, 50'
Inner flank 54
Outer flank 55
Protection duct 57
Lower and upper protection duct opening 57*a* and 57*b*
Periphery of the air supply opening 58
Transition region 60

Weld seam 70
Front wall plane E
Longitudinal axis L
Thrust direction S
Longitudinal plane of symmetry P
Axis R
Height of the thickening h
Recess 72
Lip 74
Base 80
Base area 82
Protrusion 84
Axis Q

The invention claimed is:

1. A grate block for a combustion grate, wherein the grate block comprises a block body that has an upper wall and defines a longitudinal axis, wherein the upper wall forms a bearing face along which the incinerator charge is to be conveyed and the foremost end of which, when viewed in a thrust direction, aligned substantially parallel to the longitudinal axis, forms an edge by way of which the bearing face descends into a thrust surface formed by a front wall, the front wall has a lower bearing edge which is disposed in a plane running substantially orthogonally to the longitudinal axis and specified for coming into contact with the bearing face of a grate block adjacent in the thrust direction, wherein the upper wall has an air supply opening formed by an air supply duct running through the upper wall, wherein the air supply opening is at least partially surrounded by a thickening which projects from the bearing face and forms a protection duct, which extends the length of the air supply duct, and is specified to prevent liquid flowing into the air supply opening, wherein the protection duct is enclosed by an inner flank of the thickening and the thickening has an outer flank that adjoins the inner flank and runs in a descending manner on the side that faces away from the protection duct.

2. The grate block as claimed in claim 1, wherein the inner flank is formed so as to be adjacent to a periphery of the air supply opening that is configured in the bearing face.

3. The grate block as claimed in claim 1, wherein the cross section of the protection duct is configured so as to widen in the direction from the end of the protection duct that faces away from the bearing face to the bearing face.

4. The grate block as claimed in claim 1, wherein the cross section of the air supply duct widens in the direction away from the bearing face.

5. The grate block as claimed in claim 1, wherein the thickening has substantially the shape of a hollow truncated cone.

6. The grate block as claimed in claim 1, wherein the thickening, when viewed in a plane running parallel to the bearing face, has a U-shape or V-shape, wherein the opening of the U-shape or the V-shape is aligned in the transport direction.

7. The grate block as claimed in claim 1, wherein the thickening is welded or mechanically fastened to the grate block.

8. The grate block as claimed in claim 1, wherein the thickening is formed so as to be integral to the grate block.

9. A combustion grate comprising at least one grate block as claimed in claim 1.

10. A waste incineration plant comprising a combustion grate as claimed in claim 9.

11. A method for producing a grate block as claimed in claim 1, wherein a) a block body configured as a casting, having an upper wall and defining a longitudinal axis is provided, wherein the upper wall forms a bearing face along which the incinerator charge is to be conveyed and the foremost end of which, when viewed in a thrust direction, aligned substantially parallel to the longitudinal axis, forms an edge by way of which the bearing face descends into a thrust surface formed by a front wall, the front wall has a lower bearing edge which is disposed in a plane running substantially orthogonally to the longitudinal axis and specified for coming into contact with the bearing face of a grate block adjacent in the thrust direction, wherein the upper wall has an air supply opening formed by an air supply duct running through the upper wall, and the bearing face about the air supply opening is configured so as to be substantially planar, and b) the thickening is welded or mechanically fastened about the air supply opening.

12. A method for producing a grate block as claimed in claim 1, wherein a replacement thickening after abrasion of at least 50% of the height of the thickening, caused by the operation of the grate block, for restoring the thickening is welded or mechanically fastened.

* * * * *